United States Patent [19]

Gaubert

[11] 4,314,654

[45] Feb. 9, 1982

[54] BULK LIQUID CONTAINER HAVING A PIVOTABLE TAP

[76] Inventor: Rene J. Gaubert, 4219 Oakmore Rd., Oakland, Calif. 94602

[21] Appl. No.: 146,762

[22] Filed: May 5, 1980

Related U.S. Application Data

[63] Continuation-in-part of Ser. No. 116,475, Jan. 29, 1980, abandoned.

[51] Int. Cl.[3] ..... B67B 7/26

[52] U.S. Cl. ..... 222/83; 222/182; 222/183; 222/536; 222/541

[58] Field of Search ..... 222/81, 83, 83.5, 85, 222/86, 88, 89, 105, 182, 183, 153, 158, 533, 536, 538, 541; 220/277, 462, 463

[56] References Cited

U.S. PATENT DOCUMENTS

| | | | |
|---|---|---|---|
| 2,021,246 | 11/1935 | Vahle | 222/83 |
| 2,053,370 | 9/1936 | Kann | 222/83.5 |
| 3,137,415 | 6/1964 | Faunce | 222/183 |
| 3,138,293 | 6/1964 | Roar et al. | 222/105 |
| 3,642,172 | 2/1972 | Malas | 222/183 X |
| 3,930,286 | 1/1976 | McGowen | 222/105 X |
| 3,937,363 | 2/1976 | Anderson | 222/105 |
| 4,247,020 | 1/1981 | Desjardins | 222/105 X |

FOREIGN PATENT DOCUMENTS

| | | | |
|---|---|---|---|
| 1168464 | 10/1969 | United Kingdom | 222/183 |

*Primary Examiner*—David A. Scherbel
*Assistant Examiner*—Fred A. Silverberg
*Attorney, Agent, or Firm*—Flehr, Hohbach, Test, Albritton & Herbert

[57] ABSTRACT

An assembly unit for use with bulk containers for marketing liquids such as wine and which have an inner plastic pouch liner. The assembly unit, which includes a housing and a tap, is disposed within the carton and the housing secured to one of the carton walls. When it is desired to dispense liquid, the tap is swung outwardly and one end is caused to automatically pierce a sealing membrane of the bag and to be coupled to the same. Liquid may then be dispensed as desired by opening a valve at the outer end of the tap. Also a bulk container for the marketing of liquids like wine, the exterior carton of the container having an inner liner of plastic material and a fitting attached to a lower portion of the pouch which has an opening that is normally closed by a sealing membrane. The above assembly unit is disposed within the carton and connected to the fitting. It is accessible through the carton wall to which it is secured for outward movement to dispensing position.

17 Claims, 25 Drawing Figures

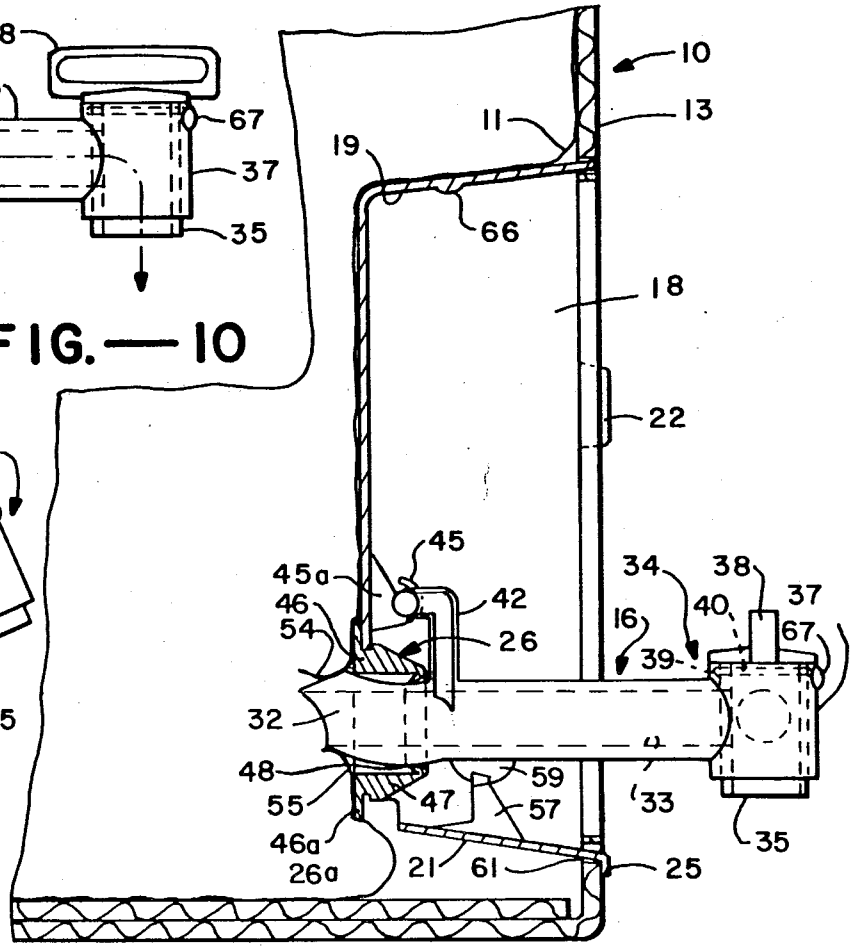
FIG.—4
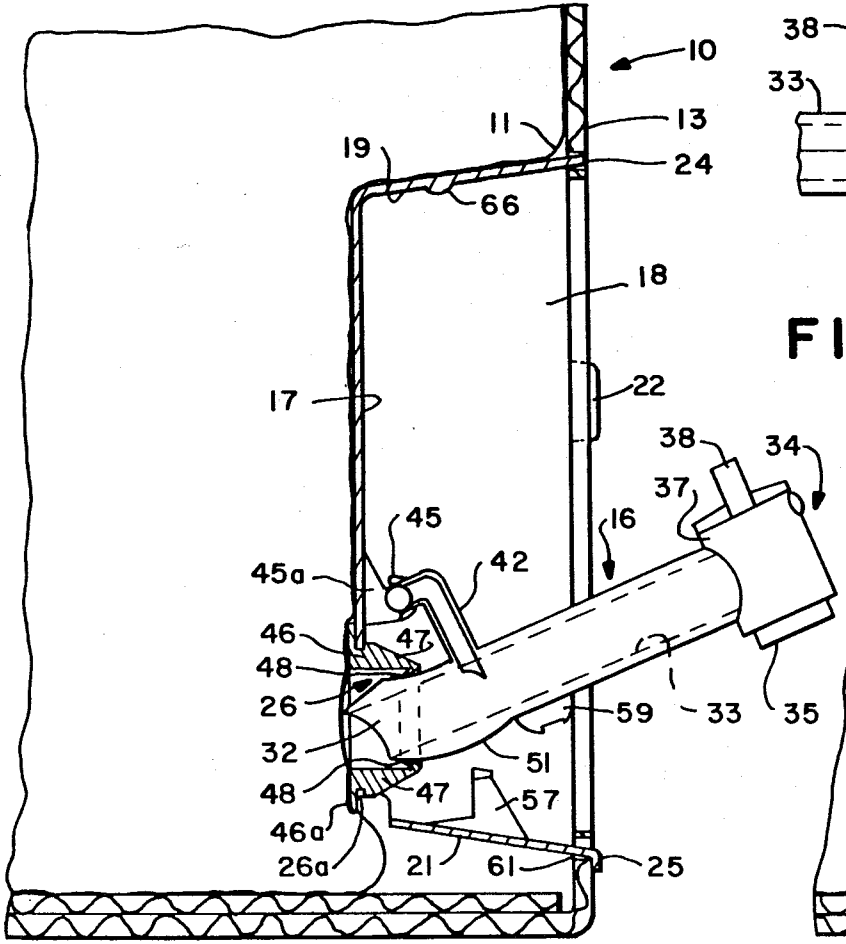
FIG.—3
FIG.—10

BULK LIQUID CONTAINER HAVING A PIVOTABLE TAP

This application is a continuation-in-part of copending application Ser. No. 116,475, filed Jan. 29, 1980, now abandoned, for Bulk Liquid Container.

This invention relates generally to bulk containers for the marketing of various liquids such as wine or milk. Also it relates to tap assemblies used with such containers.

Liquids such as wine are presently being marketed in cartons made of fiberboard and lined with a pouch made of flexible plastic material. A fitting, which likewise is made of plastic material, is bonded to one wall of the pouch and provides an opening through which liquid is introduced at the time the pouch is filled. A lower wall of the pouch is provided with another fitting which provides an opening through which liquid can be dispensed. Both the filling and dispensing fittings are normally sealed by plastic membranes. The dispensing fitting is secured to one side wall of the carton and is accessible from the exterior. When it is desired to dispense liquid, the operator forces the pointed end of a tap against the sealing membrane, thus piercing and disrupting the same, and at the same time the tap is coupled to the fitting whereby when a valve at the exterior end of the tap is opened, liquid flows from the pouch through the tap. Carton assemblies of this kind have a number of disadvantages. The tap is a separate part which may be either disposed in the upper part of the carton or supplied to the customer as a separate item. If disposed within the carton, the carton must be opened before liquid can be dispensed. Supplying the tap apart from the carton as a separate item complicates marketing. Application of the tap requires some skill to properly align the tap and to couple it to the pouch fitting. Leakage results if proper coupling is not established and maintained between the tap and the fitting.

In general, it is an object of the present invention to overcome certain disadvantages of prior containers used for the marketing and dispensing of liquids.

Another object is to provide a container which can be more conveniently used, and with less possibility of misuse.

Another object is to provide a dispensing assembly which is adapted to be installed within the interior of a carton and which includes a tap that is located and mounted in such a manner that it can be swung to dispensing position, during which movement the sealing membrane of the pouch is disrupted and the tap is coupled to the dispensing fitting.

Another object is to provide an assembly unit which includes a housing that is adapted to be connected to the dispensing fitting of the pouch and within which the tap is disposed, the unit being adapted for attachment to one wall of an exterior carton.

Another object is to provide an assembly unit having a pivoted tap which is gravity biased to swing downwardly and outwardly with respect to the wall of the carton on which the housing of the assembly is mounted, and which when further swung to a final position by manual force causes the inlet end of the tap to be coupled to the inner liquid container, to pierce the container seal, and to be locked in such position.

Another object is to provide improved means for coupling the tap to the dispensing fitting of a pouch, which forms a double seal to prevent leakage.

Another object is to provide visual liquid level gauge for such containers.

In general, the present invention consists of a dispensing assembly unit for use with a carton having a flexible plastic lining pouch, the pouch having a dispensing fitting bonded to one wall. An opening in this fitting is normally closed by a sealing membrane which when disrupted permits discharge of liquid. The assembly unit consists of a housing having connected inner and side walls and which is adapted to be secured to one side wall of the carton, near the normally lower end of the same. The interior of the housing is accessible from the exterior of the carton through an opening in the carton wall, which normally may be closed. A dispensing tap is normally disposed within the housing and is secured to the housing by a hinge or pivotal connection whereby the end of the tap which incorporates a dispensing valve may swing outwardly to dispensing position, thus causing the other end of the tap to be coupled with the bag fitting and to effect disruption of the sealing membrane. Also the invention comprises a complete carton assembly, including a plastic pouch containing liquid to be dispensed and which is disposed as a liner within an outer carton, the pouch having a dispensing fitting bonded to one wall of the same which provides an opening that is normally closed by a sealing membrane. A dispensing assembly unit as described above is coupled to the fitting and serves to house the tap within the confines of the carton.

Additional objects and features of the invention will appear from the following description in which the preferred embodiment has been set forth in detail in conjunction with the drawing.

Referring to the drawing:

FIG. 3 is a side elevational view like FIG. 1 but showing the tap in an intermediate position.

FIG. 4 is a view like FIGS. 1 and 3, showing the tap in dispensing position and the tap valve closed.

FIG. 10 shows the tap valve in open position for dispensing liquid.

Figure 13:
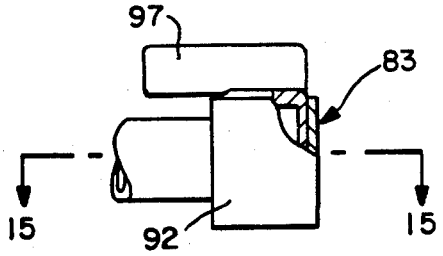
FIG. 13 is a detail showing a construction of the dispensing valve of the assembly unit of FIGS. 11 and 12.
Figure 14:
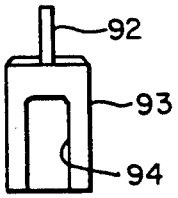
FIG. 14 is a detail illustrating the cylindrical plug part of the valve shown in FIG. 13.
Figure 15:
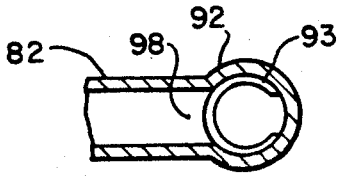

FIG. 15 has a detail in section taken along the line 15—15 of FIG. 13.

Figure 16:
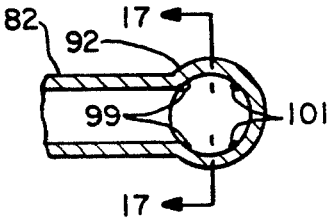

FIG. 16 is a detail in section illustrating the construction of the body of the dispensing valve.

Figure 17:
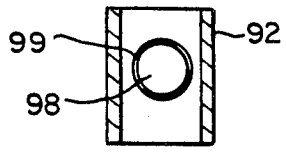

FIG. 17 is a detail taken along the section line 17—17 of FIG. 16.

Figure 11:
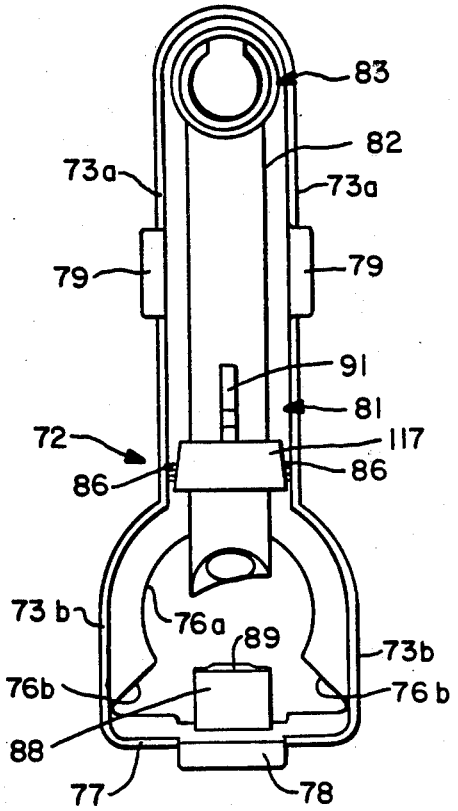
FIG. 11 is a front view showing another embodiment of tap assembly.
Figure 12:
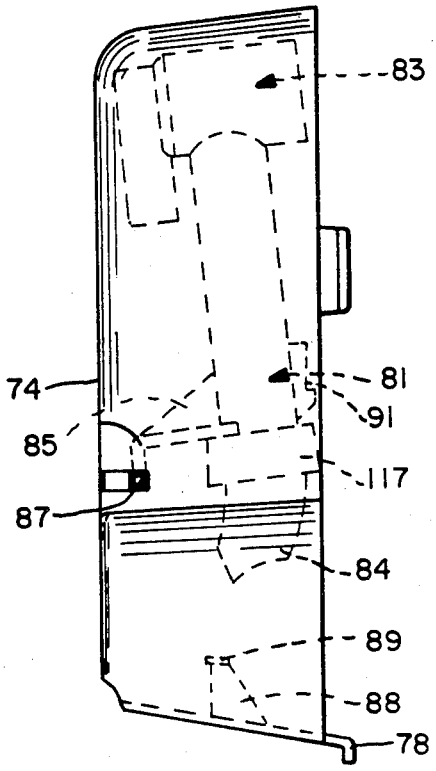
FIG. 12 is a side view of the assembly shown in FIG. 11.
Figure 18:
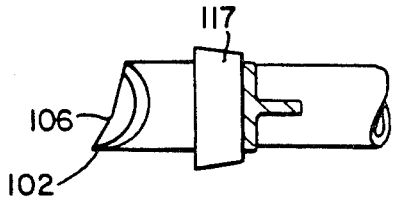

FIG. 18 is a plan view of the piercing end of the tap incorporated in FIGS. 11 and 12.

Figure 19:
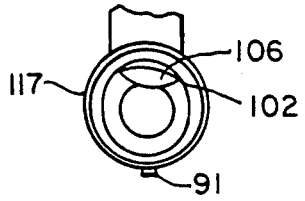

FIG. 19 has a detail linking toward the left-hand end of FIG. 18.

Figure 20:
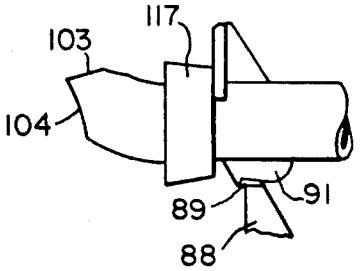

FIG. 20 is a detail looking toward one side of the piercing end of the tap.

Figure 21:
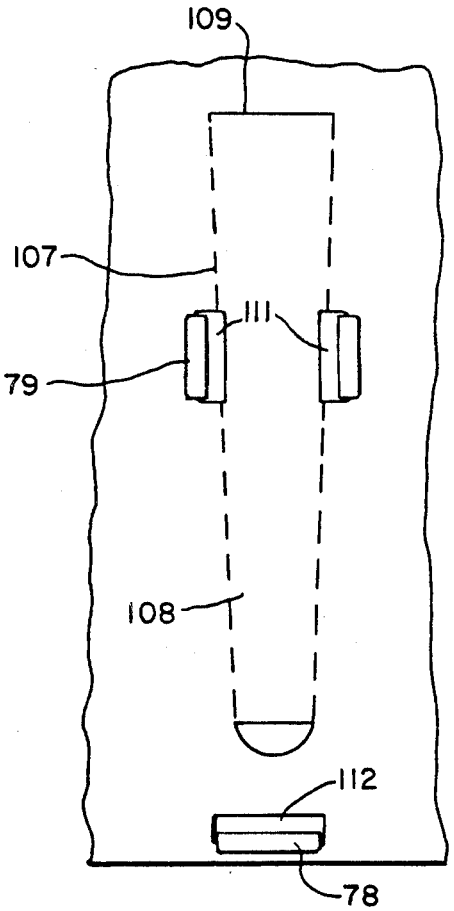

FIG. 21 illustrates the embodiment of FIGS. 11 and 12 incorporated in an outer carton.

Figure 22:
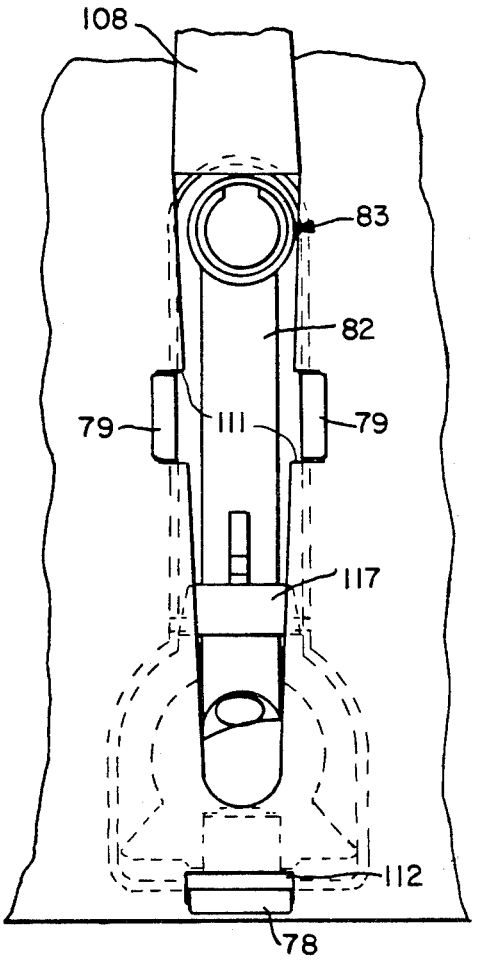

FIG. 22 is a view like FIG. 21 but with the carton cover strip removed.

Figure 23:
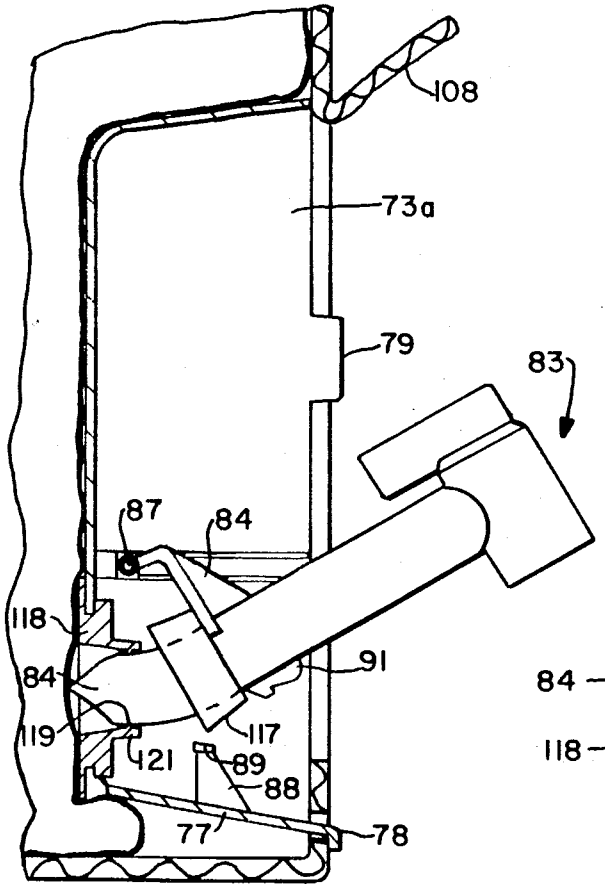

FIG. 23 is a side elevational view in section showing the tap in a position which it falls freely upon removing the cover strip.

Figure 24:
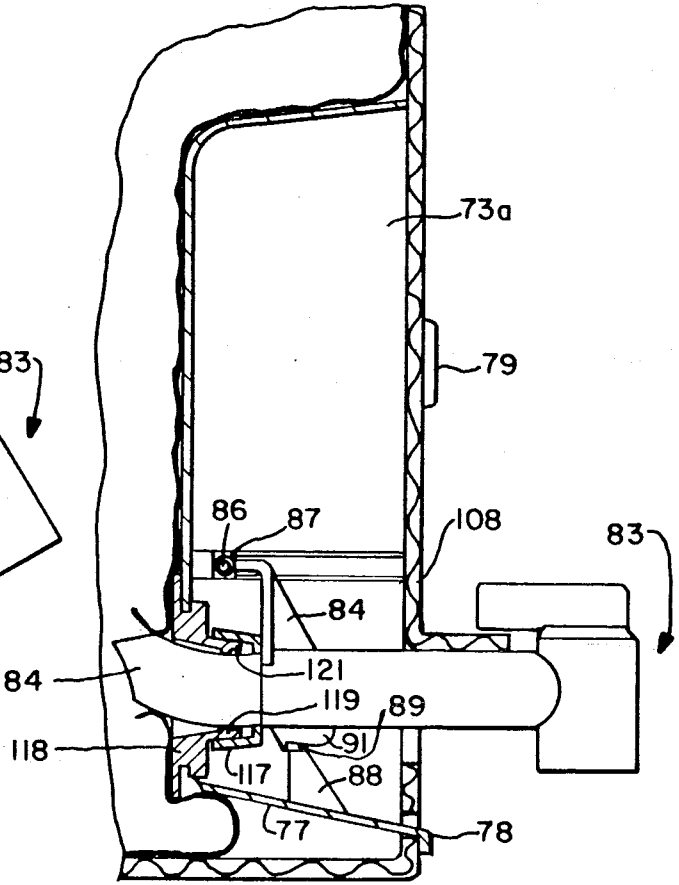

FIG. 24 is a view like FIG. 23 but showing the final position of the tap, with the piercing end of the tap the inner pouch fitting.

Figure 25:
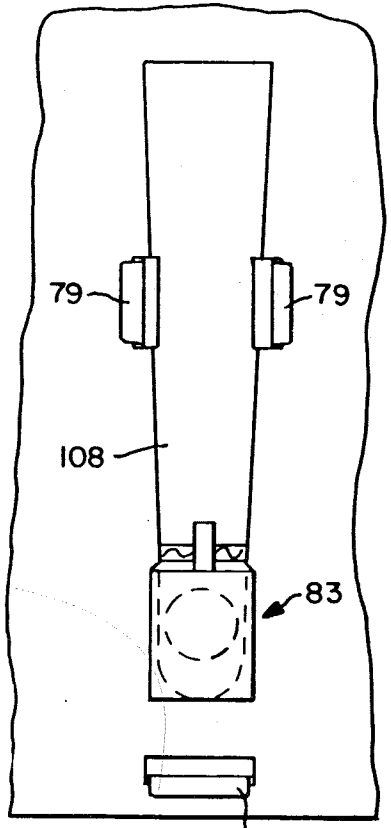

FIG. 25 is a front view like FIG. 21, but with the tap in final dispensing position, and the covering strip restored to a position and which it covers the front view of the inner housing.

Figure 2:
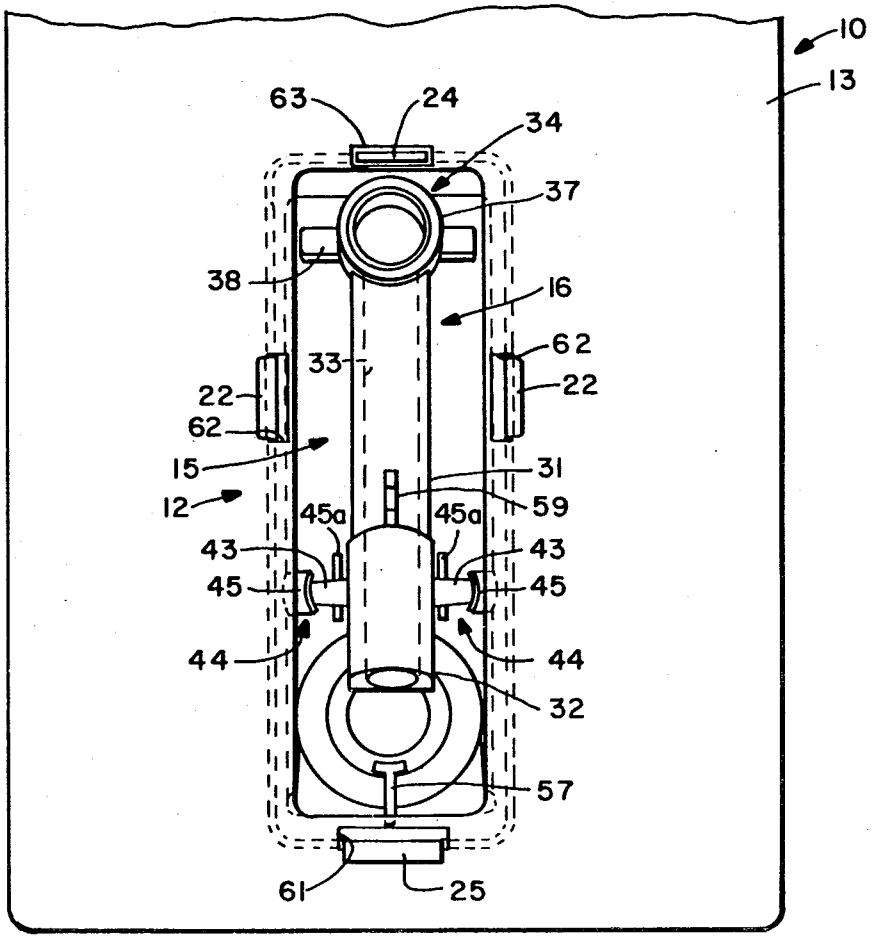
FIG. 2 is a front view of FIG. 1, with the housing cover of the assembly removed.
Figure 1:
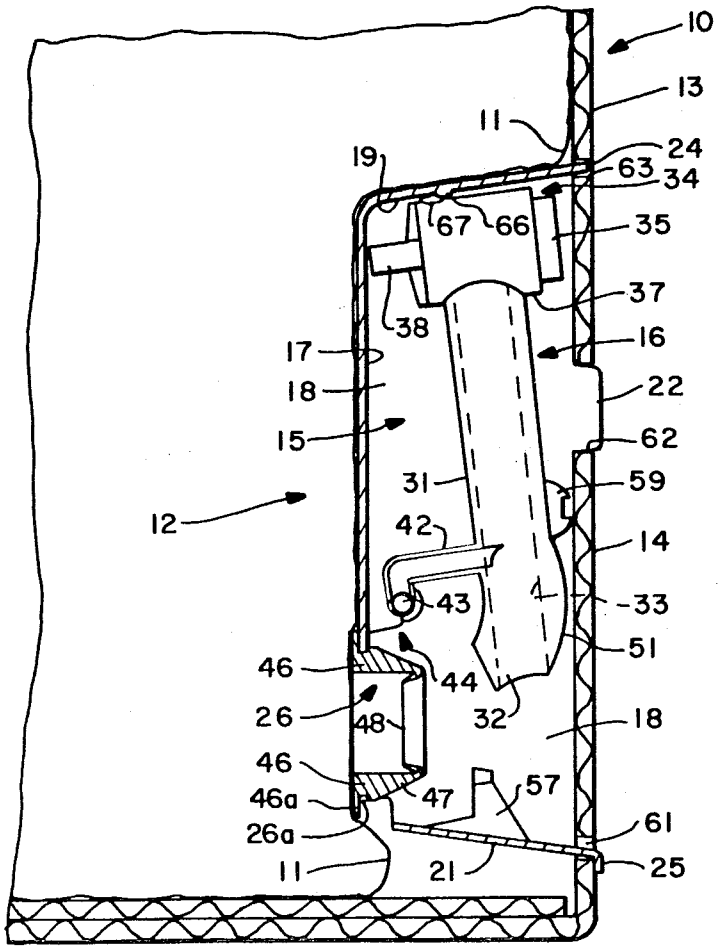
FIG. 1 is a side elevational view in section illustrating a portion of a bulk container incorporating the present invention.

The bulk container illustrated in FIG. 1 consists of an outer carton 10 of relatively stiff material, such as corrugated fiberboard, which has a shape and size depending upon the desired capacity. Within the outer carton there is a pouch 11 made of flexible plastic material such as laminated polyethylene, which is normally filled with liquid such as wine. Mounted within the carton there is a dispensing assembly unit 12 which is secured to the adjacent carton wall 13 and which is adapted to be connected to a dispensing fitting on an adjacent portion of the bag. All or a portion of the assembly unit 12 may be behind a readily removeable portion 14 of the carton wall (FIG. 1).

The assembly unit 12 preferably is made of suitable plastic material and consists of a housing 15 which serves to house and carry the tap 16. The housing (FIGS. 1, 2, 5 and 6) consists of the connected back, side, top and bottom walls 17, 18, 19 and 21. Outwardly extending tabs 22 are formed on the side walls 18. The top wall 19 is provided with a projecting tab 24 and the bottom wall 21 has a downwardly extending tab 25. The material and construction of the housing is such that the walls may be sprung during installation in the carton. Also for the purpose presently explained, the material is such that the back wall 17 is light transparent or translucent.

Figure 5:
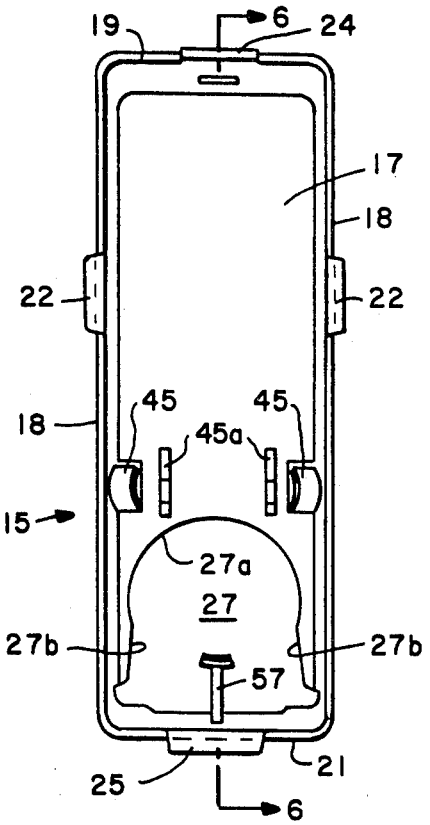
FIG. 5 is a front view of the housing for the tap.
Figure 6:
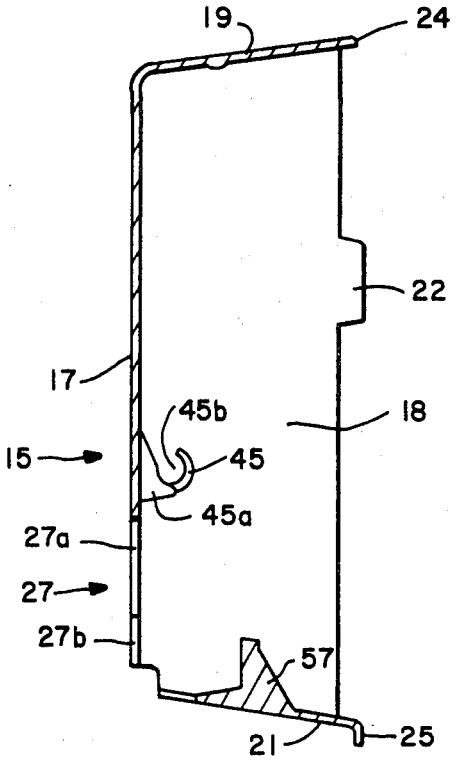
FIG. 6 is a cross-sectional view taken along the line 6—6 of FIG. 5.

As shown in FIGS. 1, 2, 5 and 6, the housing is provided with means for loosely connecting the same to the pouch fitting 26. Thus the lower portion of the back wall 17 is formed with an inverted U-shaped slot or opening (FIGS. 5 and 6). The slot is open at its lower end for receiving the fitting 26. Its upper arcuate edge 27*a* has a diameter slightly greater than the annular groove 26*a* of the fitting, and extends over an arc greater than 180° (e.g., 210°). The lower edges 27*b* are preferably downwardly divergent.

A suitable construction for the tap 16 is shown in FIGS. 1-4, 8 and 9. It consists of a tube-like body 31 which has a pointed end portion 32 that serves to pierce the sealing membrane of the bag. The passageway 33 of the body 31 opens through the end portion 32. At the other end of the body there is a valve 34, which may vary in construction but which may be a simple valve of the plug type. Thus in this instance the valve consists of the hollow cylindrical plug 35 which is fitted within the body portion 37, and which can be rotated by applying turning movement to the projecting tabs 38. A port in one side of the plug is in communication with the flow passage 33 when the valve is in open position. One or more projections 39 formed integrally on the plug 35 are accommodated in the body groove 40 and serve to retain the plug seated within the bore of the surrounding body 37. When the plug is assembled within the body, it is forced into final seating position, such movement being permitted by some distortion of the walls of the plug, and when in final seating position the plug is retained by projections 39 against accidental removal.

The tap 16 is pivotally connected to the housing whereby it can swing from the position shown in FIG. 1 to that shown in FIG. 4. For this purpose, an L-shaped arm 42 is secured to the body 31, and the extremity of the arm is pivotally mounted on the back wall 17. Thus aligned pins 43 (FIG. 2) are fixed to and extend from the L-shaped arm 42 and are carried by the bearings 44. For ease of assembly, the bearings are of the snap-on type, and make use of the arcuate spring members 45 (FIGS. 5 and 6) which can be sprung during assembly to receive the pins 43 and the tabs 45*a* that are fixed to the back wall 17 and which have arcuate surfaces 45*b* which seat the pins 43.

The coupling fitting 26 is formed to enable ready attachment to the housing and to have flexible sealing engagement with the tap when the latter is in dispensing position (FIG. 4). In the form shown, it has an annular portion 46 which has a flange 46*a*. The flange 46*a* and preferably the continuous surface of the base portion 46 are bonded (e.g., heat sealed) to the wall of the bag. Also it has an annular convergent extension 47 which may be in the general form of a truncated cone. An annular in-turned edge portion 48 (FIGS. 1 and 3) on the end of portion 47 forms a sealing edge. The fitting is preferably formed of resilient plastic whereby portions 47 and 48 are pliable. Attachment of the fitting to the housing is effected by engaging the housing edges 27*b* with the groove 26*a* of the fitting, while the plane of the groove is coincident with the plane of the back wall 17. Manual movement through the space between edges 27*b* involves some lateral distortion of the fitting. When the fitting reaches its normal position the arcuate edge 27*a* is engaged within the groove 26*a* with sufficient looseness to permit some self-alignment with the tap when the latter is swung to dispensing position. The fact that the spacing between edges 27*b* is less than the groove diameter serves to retain the fitting in its normal attached position.

Figure 8:
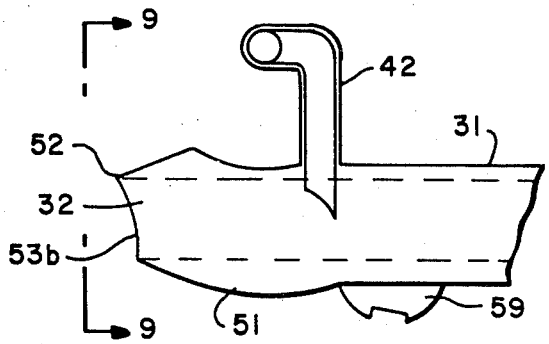
FIG. 8 is a side view illustrating that part of the tap which pierces and forms a seal with the plastic pouch.
Figure 9:
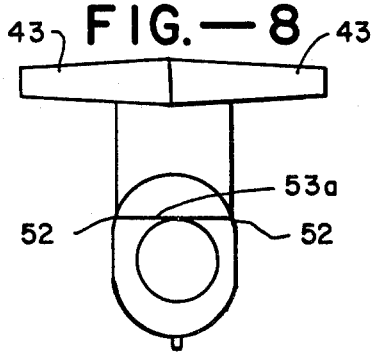
FIG. 9 is a view looking toward the left-hand end of FIG. 8.

The body of the tap is formed to cooperate with the coupling fitting 26 to form an effective seal when the tap is swung to the dispensing position shown in FIG. 4. The main portion of the tap body 31 (FIG. 8), namely the portion extending from arm 42 to the valve 34, is linear. The portion 51 which extends between arm 42 and the piercing end 32 is arcuate and is greater in diameter than that of the linear body portion. As illustrated in FIG. 8, the arc to which portion 51 conforms is over an angle of the order of 70°, taking the pivotal axis of the tap as the arc center. The piercing end 32 has the configuration shown in FIGS. 8 and 9 and provides laterally spaced piercing points 52 that are joined by the cutting edge 53*a* and the arcuate edges 53*b*. When pressed against the plastic film as illustrated in FIG. 3, the film is pierced in two laterally spaced places by points 52, and as the tap continues to move into the fitting 26 to its final position, the cutting edges sever the film to form upper and lower film portions or flaps 54 and 55 which are out of the way and do not block the flow passages through the tap. Because of relatively loose attachment of fitting 26 to the back wall of the housing and also the pliable nature of portions 47 and 48, some self-aligning action is permitted which aids in insuring an effective seal about the tap. The seal is established between sealing portion 48 and the surface of the portion 51, the portion 48 being stressed from a smaller diameter to the largest diameter of portion 51 during movement of the tap to dispensing position.

As shown in FIG. 1, the pivotal axis of arm 42 and the tap is in a plane coincident with the seal portion 48 of the fitting. The area of portion 51 engaged by seal portion 48 is circular in section. That part of arcuate portion 51 extending from this sealing area to the piercing end is preferably tapered to a smaller diameter comparable to the inner diameter of the portion 48 when unstressed.

Means is provided for locking the tap in its dispensing position. Thus an abutment 57 is fixed to the end wall 21 of the housing and its upper end is formed to provide a latch. A notched member 59 is fixed to the tap body whereby when the tap is swung to dispensing position member 59 latches onto member 57, thus locking the tap against further movement. Such latching movement is accommodated by downward springing of end wall 21.

Figure 7:
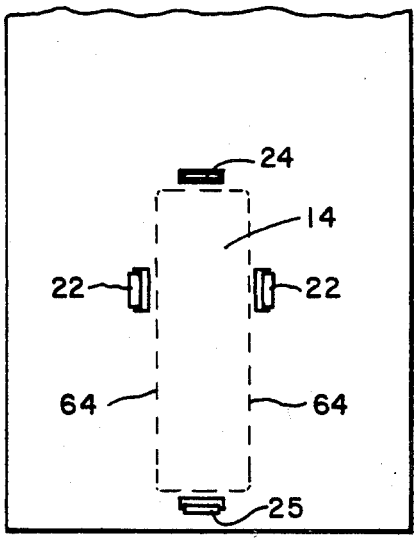
FIG. 7 shows one wall of the carton with a removeable portion overlying the inner tap, the view being on a reduced scale.

Installation of the complete assembly unit within the outer carton 10 can be carried out as follows. The fitting 26 is coupled to the back wall 17 of the housing and the housing is then attached to the wall 13 of the carton. To facilitate making this attachment, the carton is inverted and the flaps forming the carton bottom are swung out of the way. The housing is then lowered into the carton and the tab 25 inserted into an accommodating slot 61 formed in the carton wall 13. This insertion is made when the housing is generally horizontal, after which the housing is swung to its normal vertical position and the tabs 22 inserted in the carton slots 62. This insertion can be made by manually springing the side walls of the housing inwardly to facilitate entrance of the tabs 22 into the slots 62 whereby when the walls are released the tabs serve to retain the housing in vertical position and attached to the carton wall 13. In this operation the upper tab 24 is likewise engaged within the carton slot 63. The carton wall at that time includes the cover portion 14 which is attached to the surrounding wall of the line of perforations 64 (FIG. 7). The edges of the housing adjacent wall 13 are in abutting relation with the inner wall surface on an area surrounding the line of perforations 64. It will be understood that when this installation is made the tap is within the housing and positioned as shown in FIG. 1. It is retained in this position by the detent means provided by the engaged protrusions 66 and 67 (FIG. 1) formed on wall 21 and the body of valve 34, respectively. After installing the housing with the tap, the carton is returned to normal upright position and the plastic pouch is filled with liquid (e.g., wine) whereby the flexible plastic walls of the pouch tend to press against and about the housing.

The entire assembly is marketed with the housing and tap installed within the carton and the pouch filled with liquid to be dispensed. When it is desired to dispense liquid, the carton cover 14 is manually engaged and removed by severing along the perforations 64, after which the tap is engaged and swung to the dispensing position shown in FIG. 4. During such initial movement wall 19 is sprung to permit protrusion 67 to pass protrusion 66. As previously explained, when the tap is swung beyond the position shown in FIG. 3 to its final position shown in FIG. 4, the plastic seal of the pouch is pierced whereby upon opening the dispensing valve 34 liquid is free to flow through the passageway through the tap and through the open valve. The seal between the tap and the fitting 26 is established before piercing of the pouch seal, thus preventing leakage during piercing and further movement of the tap to final position.

It will be evident that the invention has a number of desirable features. Particularly, the entire assembly unit which includes the tap is installed in the carton, preferably before the pouch is filled with liquid. Application of the tap is greatly simplified because it is only necessary to swing the tap to the final locked position shown in FIG. 4. The tap remains in this locked position until all of the liquid contents have been dispensed. Once in the position shown in FIG. 4, the tap is held coupled to the pouch and operation of the valve to dispense liquid cannot apply forces which might disrupt this connection.

As previously mentioned, the plastic material used in constructing the housing preferably is transparent or translucent. This makes possible a novel feature, namely the functioning of the back wall 17 of the housing as a liquid level indicator. Thus after removal of the carton cover portion 14 and movement of the tap to dispensing position, the surface of the liquid when below the top of the housing can be readily seen, thus providing a liquid level indicator as the level approaches the bottom of the carton.

The embodiment of the invention illustrated in FIGS. 11–25 has certain features which are deemed desirable and are not incorporated in the previous described embodiment. Particularly means are provided in forming a double seal between the piercing end of the tap and the dispensing fitting. As is shown in FIGS. 11 and 12, the housing 72 is again made of suitable molded plastic material with the walls having a substantial amount of spring or give. Assuming that the unit is installed in upright position, as illustrated in FIGS. 11 and 12, the side wall portions **73*a* are closer together than in the previously described embodiment and the lower side wall portions 73*b* are sufficiently spaced far apart to include the means for coupling the housing to the dispensing fitting of the inner pouch. With this construction, the housing occupies a relatively smaller volume than the embodiment previously described. The lower portion of the back wall 74 has been formed to provide means of coupling the same to the dispensing fitting of a container pouch. Particularly, it has an opening 76 corresponding to the opening 27 of FIG. 5, and an arcuate edge 76*a* corresponding to the edge 27*a* of FIG. 5. Portions 76*b* correspond generally to the portions 27*b* of FIG. 5. The bottom wall 77 is provided with the tab 78, and the upper portions of the side walls 73*a*, are provided with laterally extending tabs 79**.

The tap 81 disposed within the housing differs in dimensions from the tap first described and consists of the tubular body 82 having the valve 83 secured to one end. The other end 84 of the body constitutes the piercing end, and is adapted to pierce the sealing closure of the dispensing fitting. An L-shaped arm 84 corresponding to the arm 42 of FIG. 8, is likewise fixed to the body 81, and is carried by pivot pins 86, which are pivotally accommodated within the apertures 87 formed in the side wall portions **73*a*. As is evidenced from FIG. 12, the center of gravity of the tap is to the right of the axis of pivot pins 86, whereby when the tap is not held within the housing, as shown in FIG. 12**, it freely swings outwardly and downwardly.

The means for limiting downward movement of the tap and for locking it in dispensing position consists of the abutment or pedestal 88, which is fixed to the bottom wall 77 of the housing. The abutment carries a member 89 that cooperates with member 91 that is fixed to the tap body, the two members forming latching means for locking the tap in the horizontal dispensing position shown in FIG. 24. Member 89 can be a simple lug, and member 91 may be a notched member which snaps over the lug 89 when the tap is forced to its final dispensing position.

A suitable type of dispensing valve 83 is shown in FIGS. 13–17. It consists of a body 92 having a cylindrical bore, and fitted with a plug 93. The plug is hollow and one side is provided with a slot 94 which forms a port. One end of the plug is closed by portion 96, to which the hand-hold or tab 97 is secured. One side of the body has an opening 98 which communicates with the tubular body portion 82. Normally, the hand-hold or tab 97 extends downwardly when the tap is within the housing and before it has been swung to dispensing position. In this position, the valve is closed. The valve remains closed when the tab 97 is turned 90° from the position shown in FIG. 12. However, when the tab is turned to a position 180° from that shown in FIG. 12, the port slot 94 of the plug is brought into registration with the opening 98 to permit liquid to flow into the cavity within the plug, from thence to be discharged.

The construction illustrated particularly in FIGS. 16 and 17 facilitates maintaining a good fluid tight seal for the closed positions. As shown in FIG. 17, immediately surrounding the opening 98 into the body, the adjacent surface of the body bore is provided with the molded bead 99. This bead projects slightly from the adjacent surface of the body bore. In addition, on opposing sides of the bore, ribs 101 are provided which protrude a slight distance from the surface of the body bore. When the valve plug is in closed position, ribs 101 apply force against the plug with the result that the plug is sprung to a slightly smaller diameter and urged against the bead 99, thus providing sealing engagement over an area surrounding the opening 98. It may be pointed out that all of the parts of the tap, including the dispensing valve just described, are made of suitable molded plastic material which has a certain amount of inherent spring.

The piercing end of the tap illustrated in FIGS. 18–20, is somewhat different from the piercing end previously described. In general, the configuration of the piercing point is such as to provide a single relatively sharp piercing point 102 which initiates piercing of the sealing membrane. This point is formed by shaping the end of the tap to the configuration shown in FIGS. 18–20. The shaping includes the areas 103 and 104, which converge along the edge 106, and which are inclined to the axis of the passageway through the tap, as shown in FIG. 18. This provides not only the point 102 for initiating penetration of the sealing membrane, but in addition, provides a cutting edge 106. The configuration just described makes possible piercing of the sealing membrane with less force than the configuration previously described.

The carton wall to which the assembly unit just described is attached, is shown in FIG. 21. Perforations 107 provide a strip 108 which can be manually pulled loose from the carton, and bent upwardly along the fold line 109. If desired, in place of the fold line 109, there may be further perforations whereby the strip can be removed in entirety. Slots 111 in the carton wall accommodate the tabs 79 and a slot 112 near the bottom of the carton, accommodates the tab 78. When the assembly unit is being mounted on the carton wall, the tab 78 is first engaged with the slot 112, and then by squeezing the side walls **73*a* of the housing, the tabs 79 are inserted through the slots 111**. The mounting of an assembly unit upon one wall of the carton is carried out after the housing has been coupled to a dispensing fitting of the associated pouch.

The appearance of the carton wall after installation of the assembly unit is substantially as shown in FIG. 21. When the strip 108 is removed or folded back, the appearance is as shown in FIG. 22. Immediately following removal of the tongue 108, the tap falls forwardly and downwardly to a position such as shown in FIG. 23. In this position, the piercing end of the tap has commenced to move into the dispensing fitting but the sealing membrane has not been pierced. Further downward movement is prevented primarily by friction between the tap and the dispensing fitting. Manual force is then applied to the projecting end of the tap to force it to the final position shown in FIG. 22. This serves to bring the members 89 and 91 into locking relationship and during such movement, the piercing end of the tap body is brought into sealing relationship with the dispensing fitting and during the final movement, the piercing end pierces the sealing membrane. The liquid contents can now be dispensed by turning the dispensing valve to open position. In some instances, it may be desirable to close the housing by returning the tongue to the position shown in FIG. 25. When the tongue 108 is folded upwardly or removed entirely, and the liquid level is below the upper end of the housing, the liquid level is apparent by viewing the housing, thus providing means for determining when the contents have been completely dispensed, or the quantity of the remaining liquid.

The means provided for forming a double seal between the tap body and the fitting 116 is shown particularly in FIGS. 23 and 24. An annular socket 117 surrounds the body near the piercing end and may be molded as an integral part of the tap body. Its inner peripheral surface conforms to a truncated cone. The fitting 118 differs from that previously described. It is shorter in length, and it has an inner annular sealing rib 119 of such diameter that it forms an initial seal with the piercing end of the tap before manual force on the top causes penetration of the sealing membrane. As movement of the tap continues under manual force the seal is broken and the end portion 121 of the fitting is embraced by the socket 117. Final movement to locking position forces the socket over the end portion 121 of the fitting, thus establishing a secondary fluid tight seal. Also forces applied by stressing of the socket and the end portion of the fitting serves to increase sealing pressure between the rib 119 and the piercing end of the tap, thus aiding the desired fluid tight seal.

What is claimed is:

1. A dispensing assembly unit for use with a carton having a flexible plastic lining pouch, the pouch having a fitting bonded to one wall of the same, the fitting having an opening therethrough and a sealing membrane normally closing the opening, the membrane when disrupted permitting discharge of liquid within the pouch, the assembly unit comprising means forming a separate housing, a dispensing tap normally accommodated within the housing, means for attaching the housing to one side wall of the carton near the bottom of the same with the interior of the housing being accessible from the exterior of the carton, the dispensing tap having a portion at one end of the same formed to pierce the sealing membrane when forced against the same and having a dispensing valve at the other end of the tap, the tap also having a flow passage for conveying liquid from said one end to the valve, and means for attaching the tap to said housing for swinging movement of the tap between a normal position in which it is accommodated within the housing to a dispensing position in which said one end of the tap is disposed within the opening of the pouch fitting and within the housing to thereby pierce the sealing membrane and the valve disposed exterior of the housing and carton.

2. A dispensing assembly unit as in claim 1 in which the means for attaching the tap to the housing consists of an arm secured to the tap and means for pivotally attaching the arm to the housing whereby when the tap is swung from its normal position within the housing to said dispensing position, said one end of the tap is caused to pierce and disrupt the sealing membrane and to establish sealing engagement with the fitting.

3. A dispensing assembly unit as in claim 2 in which the arm is L-shaped.

4. A dispensing assembly unit as in claim 2 in which the tap consists of a body having a linear portion extending from said valve and an arcuate portion connecting the piercing portion with the linear portion.

5. A dispensing assembly unit as in claim 2 in which one wall of the housing is formed to provide a recess adapted to accommodate and retain said fitting.

6. A dispensing assembly as in claim 2 in which, when the assembly is in vertical position, the center of gravity of the tap is offset from the axis of the pivotal connection whereby when the tap is not restrained it swings outwardly and downwardly by gravity.

7. A dispensing assembly unit as in claim 1 in which means is provided for locking the tap in dispensing position.

8. A dispensing assembly unit as in claim 1 in which said piercing end portion has two piercing points joined by a cutting edge.

9. A dispensing assembly unit as in claim 1 wherein the housing is adapted to be attached to the dispensing fitting having an outer annular groove, in which the housing comprises connected side, end and back walls, the back wall having an opening defined by an arcuate edge extending over an angle greater than 180°, the terminals of the arcuate edge being spaced apart by a distance less than the diameter of the groove, said opening being dimensioned to receive the groove of the plastic fitting, the arcuate edge and the fitting groove being so dimensioned that the fitting is distorted as it is forced between the terminals of the arcuate edge and positioned with its center aligned with the center of the arcuate edge and with the edge within the groove.

10. An assembly unit as in claim 9 in which the diameter of the groove is slightly less than the diameter of the arcuate edge.

11. A bulk container for the marketing of liquids such as wine, comprising an outer carton, a plastic pouch disposed within the carton and forming a liner for the same, a lower wall of the bag having a fitting bonded to the same, the fitting providing an opening, a sealing membrane normally closing the opening, a separate dispensing assembly unit coupled to the fitting, said assembly unit being secured to one wall of the carton near the lower end thereof, said unit comprising a separate housing coupled to the fitting and a tap accommodated within the housing, the interior of the housing being accessible from the exterior of the carton, and means connecting the tap to the housing whereby the tap is manually swung from a position completely within the housing to a dispensing position in which one end of the tap is within the housing and coupled with the fitting and another end of the tap having a valve being disposed exterior of the housing and the carton, said one end of the tap being formed to disrupt the sealing membrane when the tap is moved to said dispensing position.

12. A bulk container as in claim 11 in which said connecting means consists of an arm secured to the tap, and means forming a pivotal connection between said arm and the housing.

13. The bulk container as in claim 11 in which the means for coupling the pouch fitting to the housing is proportioned to permit self-aligning movement of the fitting when the tap is coupled with the same.

14. A bulk container as in claim 11 in which means is provided for locking the tap in dispensing position.

15. A bulk container as in claim 11 in which the fitting comprises an annular portion bonded to one wall of the pouch, an annular extension projecting into the housing, and an annular sealing portion formed on the extension dimensioned to seal about the adjacent portion of the tap when the tap is in its dispensing position.

16. A bulk container as in claim 11 in which the housing is provided with locking tabs and the said one wall of the carton has slots dimensioned to receive said tabs.

17. A bulk container as in claim 11 in which a vertically extending wall of the housing is made of transparent or translucent material, thereby providing a liquid level indicator.

* * * * *